United States Patent [19]

Munoz

[11] Patent Number: 4,723,688

[45] Date of Patent: Feb. 9, 1988

[54] BEVERAGE CONTAINER AND DISPENSER

[76] Inventor: Edward A. Munoz, 66 Cleary Ct., Apt. 502, San Francisco, Calif. 94109

[21] Appl. No.: 548,285

[22] Filed: Nov. 3, 1983

[51] Int. Cl.[4] ..... B67B 7/24; F28D 7/10

[52] U.S. Cl. ..... 222/88; 222/105; 222/146.6; 222/185; 222/386.5; 165/140

[58] Field of Search ..... 222/386.5, 146.6, 81, 222/82, 83, 83.5, 105, 129, 132, 185, 88; 62/390, 397; 165/140

[56] References Cited

U.S. PATENT DOCUMENTS

| | | | |
|---|---|---|---|
| 291,161 | 1/1884 | Dankhoff | 222/129 |
| 593,080 | 11/1897 | Case | 222/129 |
| 1,248,705 | 12/1917 | Pogue | 222/83.5 |
| 2,321,836 | 6/1943 | Marzo | 222/386.5 |
| 2,437,257 | 1/1985 | Johnson | 62/390 |
| 2,746,641 | 5/1956 | King | 222/132 |
| 2,781,152 | 2/1957 | Van Slyke | 222/81 |
| 3,088,289 | 5/1963 | Alex | 62/397 |
| 3,367,133 | 2/1968 | Dreis et al. | 62/397 |
| 3,409,714 | 11/1968 | Strugar, Jr. | 222/105 |
| 3,414,165 | 12/1968 | Goodenow | 222/83 |
| 3,474,933 | 10/1969 | Malpas | 222/386.5 |
| 3,933,275 | 1/1976 | Metzner et al. | 222/146.6 |
| 4,251,012 | 2/1981 | Owens et al. | 222/185 |
| 4,491,244 | 1/1985 | Yanes | 222/146.6 |

FOREIGN PATENT DOCUMENTS

| | | | |
|---|---|---|---|
| 2229617 | 1/1974 | Fed. Rep. of Germany | 222/386.5 |

*Primary Examiner*—Joseph J. Rolla
*Assistant Examiner*—Gregory L. Huson

[57] ABSTRACT

A beverage dispenser comprised of a removable storage container incorporating an expandable bag which can be opened to the atmosphere to allow withdrawal of beverage from the container through a dispensing and cooling assembly with minimal exposure to air.

4 Claims, 6 Drawing Figures

BEVERAGE CONTAINER AND DISPENSER

BACKGROUND OF THE INVENTION

Field of the Invention

This invention relates to a beverage container for transport and storage and to apparatus to be used in association therewith for dispensing the beverage contained therein.

SUMMARY OF THE INVENTION

This invention is directed to a container for storing and transporting beverages, particularly still wine, and for dispensing apparatus to be used therewith.

Accordingly, it is an object of this invention to provide a container for storage and transport of wine which is relatively lighweight and essentially impervious to atmospheric oxygen to prevent degradation and quality loss of contained wine by air oxidation.

A further object of this invention is to provide apparatus for storing and dispensing wine which will minimize alcohol loss during transport and storage.

Another object of this invention is to provide dispensing apparatus useful in association with said beverage containers, adapted to permit removal and replacement of said containers without substantial exposure of contained beverage to atmospheric air.

A still further object of this invention is to provide apparatus for dispensing two or more different beverages each at a predetermined individual temperature which may be the same or different.

These and other objects of this invention and other advantages and features of this invention are described in the following description and in the accompanying drawings.

BRIEF DESCRIPTION OF THE DRAWINGS

Referring now to FIG. 1, it will be seen that the replaceable container for transporting beverages, particularly wine, in accordance with this invention is comprised of a rigid or semi-rigid container 11 which is preferably a relatively oxygen impermeable plastic container, preferably blow molded high density polyethylene of sufficient thickness to provide adequate structural integrity for the amount of beverage to be contained and also of sufficient thickness to prevent substantial permeation of oxygen in atmospheric air into the inside of the container. Other materials, such as stainless steel and other plastic materials, can also be used provided they possess adequate structural integrity and resistance to oxygen permeation. For reasons of weight, cost and ease of fabrication, commercially available polyvinyl chloride or high density polyethylene resin is preferred. In the case of high density polyethylene, a blow molded container lined with a thin layer of an oxygen barrier material such as a vinyl chloride, vinylidene chloride copolymer (trademark SARAN) is preferred. In general, a high density polyethylene storage container capable of storing and transporting as much as 20 liters of beverage should range from about 0.025 to about 0.50 millimeters in thickness to provide satisfactory physical properties.

Figure 1:
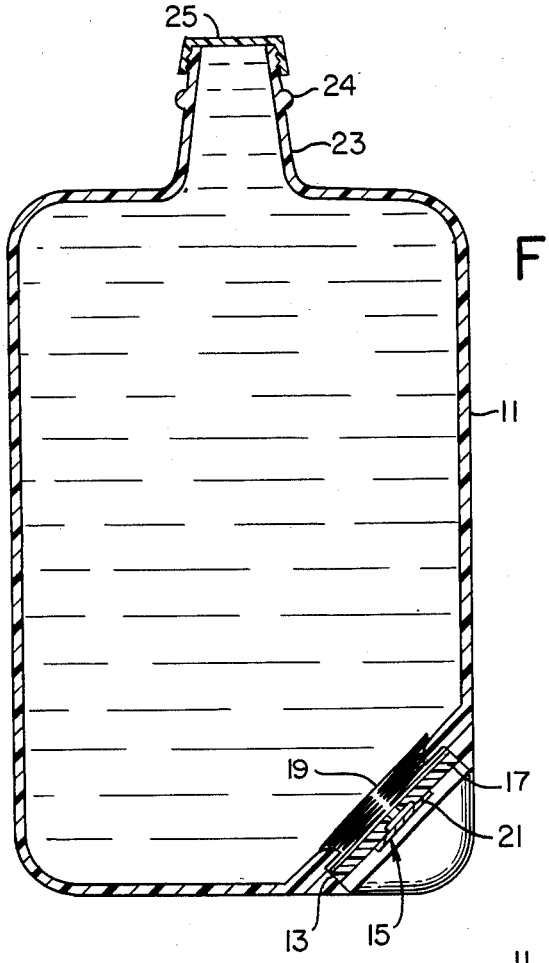
FIG. 1 is a semi-schematic crossectional view of a container according to this invention.

An opening 13 is provided in container in a convenient location, which preferably will be at or near the top of the container when placed in position for removal of its contents and which also will not protrude or otherwise interfere with stacking or packaging during storage or shipment. A simple indentation in the container, as shown, is preferred for this purpose. The opening 13 is provided for ease of filling the container and for attachment of vent means 15 in sealing engagement with the walls of container 11. Vent means 15, as shown in FIG. 1, is comprised of an annular disc 17 which may be attached to container 11 by means of threads, heat sealing or the like. The aperture of an expandable bag 19, preferably of plastic or elastomeric material, is sealed to disc 17 so that the interior of bag 19 is open to the aperture of disc 17. Bag 19 is disposed within the interior of container 11. Seal 21 is provided to close the external aperture of disc 17 during storage and transport of the filled container. Additional thickness may be provided in the walls of container 11 in the vicinity of vent means 13 if necessary to provide additional structural integrity. At another location on container 11, preferably in a location generally opposite to vent means 13, the container is provided with an elongated tubular neck 23, which is adapted to engage with a dispensing apparatus in leak-free engagement, to facilitate removal of the contents of container 11. An annular thickened section 24 is provided in neck 23 to enhance leak-free engagement with a dispensing apparatus. Closure 25 is provided to close neck 23 to prevent leakage of the contents of the filled container as well as to prevent air from entering. Closure 25 is preferably of plastic material and can be attached to neck 23 by threads, as shown, or by friction, detent, glue or the like. The central portion of closure 25 is preferably composed of a frangible or puncturable material to facilitate opening of neck 23 during or after engagement of container 11 with a beverage dispensing apparatus to allow removal of the contents of container 11.

Figure 2:
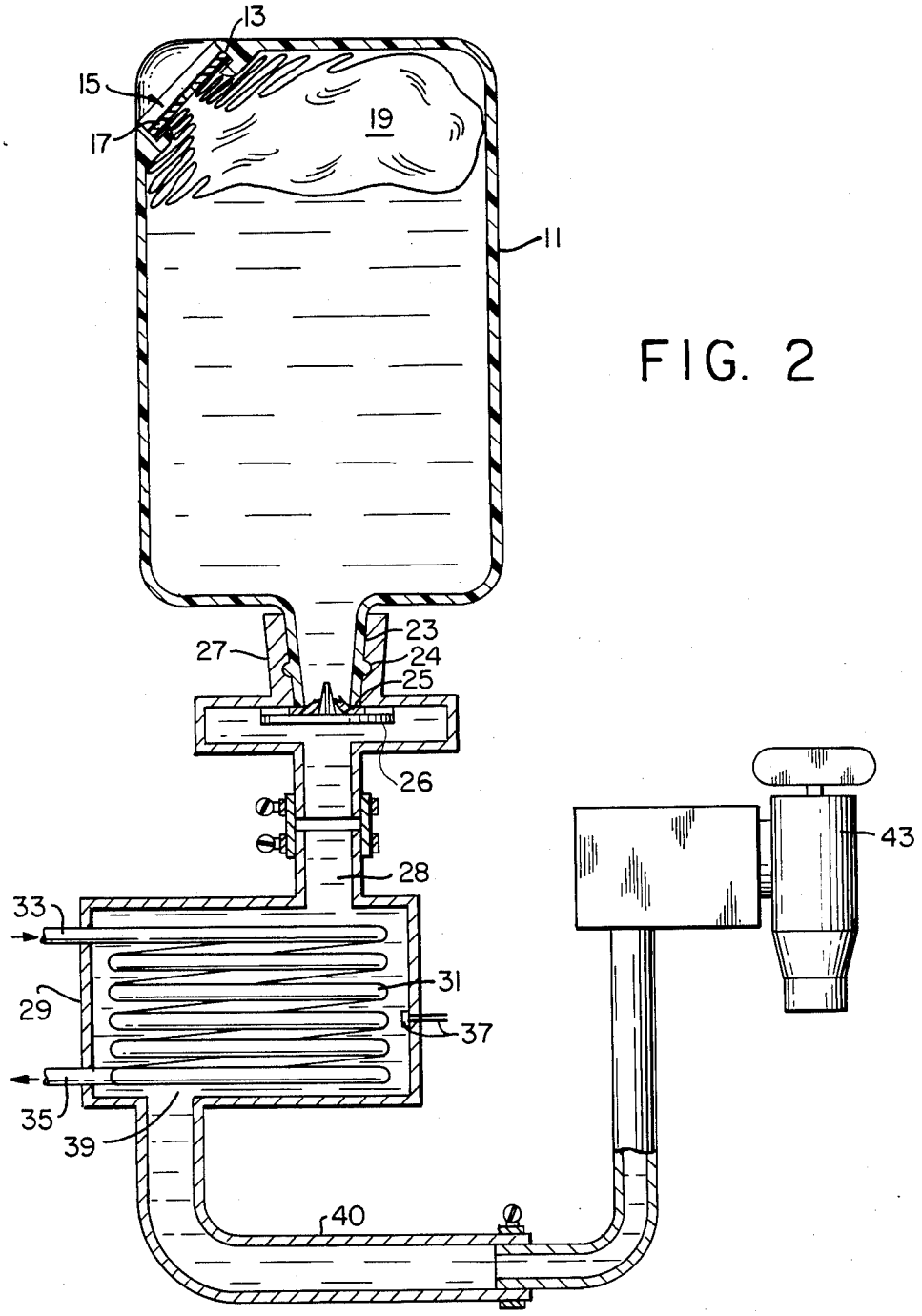
FIG. 2 is a semi-schematic crossectional view of a container in combination with a dispensing apparatus according to this invention.

Referring now to FIG. 2, there is shown a removable container, as described above, in combination with chilling and dispensing apparatus, all in accordance with this invention.

The container shown in FIG. 2 and its component parts are as described above. The dispensing apparatus, which preferably includes provision for beverage chilling as shown, is comprised of inlet means 27 adapted to engage neck 23 in leak-free and air-tight engagement and to open closure 25 at or subsequent to engagement as more fully described below. Inlet means 27 is connected to a cooling reservoir 29.

Figure 5:
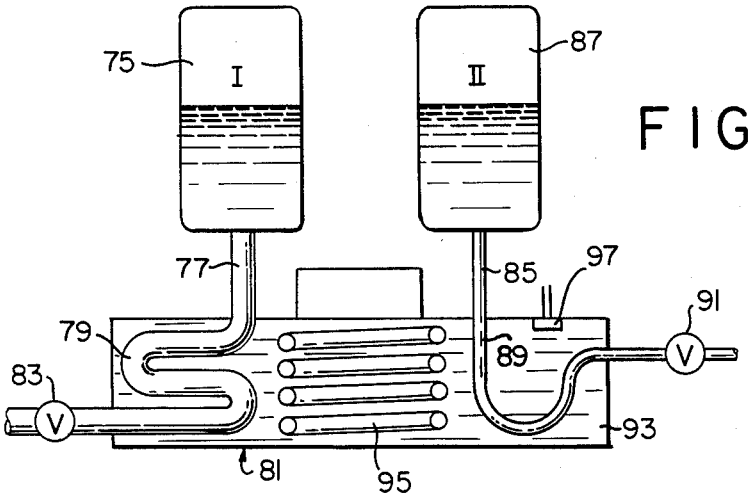
FIG. 5 is a semi-schematic crossectional view of a plurality of containers in combination with a dispensing and cooling apparatus capable of dispensing beverages at different temperatures.

Cooling reservoir 29 includes a refrigeration coil 31 which has a coolant inlet 33 and a coolant outlet 35 connected to a refrigerant source, not shown, of refrigerated coolant which can be circulated continuously or on demand to maintain the temperature of beverage contained in the interior of cooling reservoir 29 at a pre-selected, predetermined temperature. Thermostat 37 is preferably provided to regulate the refrigerant source or the rate of flow of coolant to maintain the desired beverage temperature within the cooling reservoir. Beverage can also be chilled by the passage of beverage through a coil immersed in refrigerated liquid within the cooling reservoir as shown in FIG. 5 or by external cooling of the entire reservoir. Refrigeration coil 31 can be of any substance which has good thermal conductivity and which will not cause degradation or contamination of the contained beverage. Stainless steel tubing is preferred.

Cooling reservoir outlet 39 is positioned at the bottom of reservoir 29 and is preferably displaced relative to inlet 28 to prevent breakthrough of unchilled beverage from container 11 directly into outlet 39. A baffle may also be provided over outlet 39 or under inlet 28 to promote mixing of incoming and unchilled beverage and chilled beverage within the reservoir although normally, simple displacement of the inlet and outlet will provide adequate mixing.

Cooling reservoir outlet 39 is connected by conduit 40 to a demand tap or valve 43, of conventional design, which serves to permit withdrawal of chilled beverage by gravity flow. It is preferred that valve 43 be positioned above the bottom level of cooling reservoir 29, preferably above the level of inlet 28 and below the outlet level of container 11.

As shown in FIG. 2 puncture means 26 is provided to puncture seal 25 when neck 23 of container 11 is in fully seated position within inlet means 27. Flow passages around puncture means 26 permit beverage from container 11 to enter reservoir 29 through inlet 28. When it becomes necessary to replace an emptied beverage container with a fresh full container, it is convenient to simply remove the empty container and place a new full container in position such that neck 23 fits into inlet means 27 as shown. Due to the positioning of valve 43 below the level of inlet means, as shown, opening valve 43 and withdrawing beverage from reservoir 29 remaining from the previous filling will create a sufficient vacuum to cause container 11 to be drawn into inlet means 27 a sufficient distance to cause closure 25 to be punctured to thereby permit the flow of beverage from container 11 into inlet 28 by gravity.

Although not necessary to the achievement of the benefits of this invention, it will be appreciated that in a typical configuration the dispenser will be placed within an enclosure for cosmetic and functional reasons, such as to provide a flat upper surface to allow placement or storage of beverage containers. For energy conservation reasons, the cooling reservoir and outlet conduit 41 will normally be insulated. In like fashion, the portion of refrigeration coil 31, which is external to cooling reservoir 29, will also be insulated.

For ease of replacement as well as cleaning, reservoir 23 is preferably constructed from two or more elements joined together by a bolted flange, or equivalent fastening means to facilitate easy access into its interior. All conduit connections are preferably also of semi-permanent construction, such as friction or threaded connections or simple hose and clamp type connections, for ready replacement and cleaning. While in general the materials of construction employed in all elements of the dispenser can be of any material which has adequate physical properties and which does not alter the taste of the contained beverage, or have other harmful effects, high density polyethylene and stainless steel are preferred.

Figure 3A:
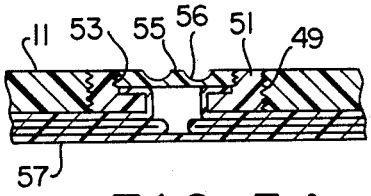
FIGS. 3A and 3B are crossectional views of alternative pressure relief means useful for equalizing internal pressures within said container with outside atmospheric pressure, as the contents of said container are withdrawn in use, without exposing the contents to atmospheric air.

Referring now to FIG. 3A, a portion of container wall 11 is shown with a threaded circular opening 49 adapted to receive an externally threaded plug 51 which is provided with an internally threaded opening 53 which is adapted to receive a threaded retainer 55 which serves the dual purpose of completing the closure of the walls of container 11 to prevent spillage of contents during storage handling and transport of filled container 11 and also to secure inflatable bag 57, which is disposed within container 11, in sealing engagement with plug 51 to prevent entry of air into the interior of container 11. When it is desired to withdraw the liquid contents of a filled container 11, the interior of bag is opened to the atmosphere by opening a small hole in retainer 55. This may be facilitated by providing a small diameter section or depression 56 in retainer 55, as shown which can be easily opened with a sharp implement. Alternatively, a small predrilled hole can be provided in retainer 55 which is closed with tape or a plastic seal during transport and which is readily removed by shipping when the contents of container 11 are to be withdrawn.

Figure 3B:
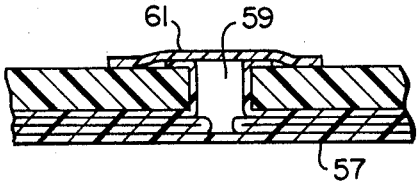

An alternate closure is shown in FIG. 3B in which the outside of the opening of bag 57 is passed through an opening 59 in container 11 and secured to the outside of container 11 in sealing engagement by heat sealing, adhesive or the like to prevent air from passing into the interior of container 11. A removable seal 61 of paper, metal foil, plastic or the like is affixed over the opening 59 of bag 57 to prevent expulsion of the contents of container 11 during handling and shipment.

Variations of the closure means shown will readily occur to those skilled in the art. The particular closure means selected is not essential to the practice of this invention so long as it is sufficiently secure to prevent spillage during transport and handling and can be opened to permit equalization of pressure within container 11 during removal of liquids without exposing the contained liquids to air.

Figure 4:
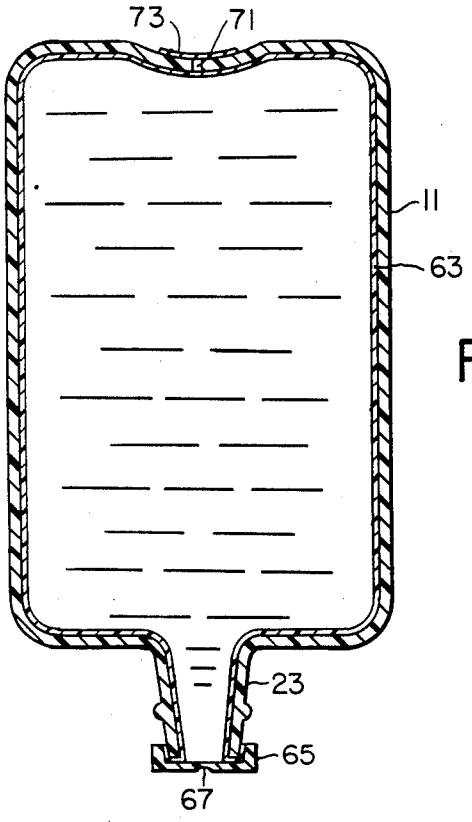
FIG. 4 is an alternative view of a container useful in combination with a beverage dispenser according to this invention.

Referring now to FIG. 4, an alternative container assembly is shown for use in accordance with this invention. In this embodiment a flexible liner 63, preferably of a material resistant to oxygen permeation is disposed within container 11 and extending into and over the mouth of neck 23 where it is held in place and in sealing engagement with neck 23 by a friction or heat sealed closure 65. As in the embodiment shown in FIG. 1, the closure 65 is made of a frangible or puncturable material to facilitate opening of neck 23 and removal of beverage contents from container 11 during or after engagement of container 11 with a beverage dispensing apparatus. A detent 67 may be provided in closure 65, as shown to facilitate opening of neck 23. A thickened annular section 69 may be provided in neck 23, as shown to provide better sealing when container 11 is engaged with a dispensing apparatus.

Filling of beverage to be transported in the container shown in FIG. 4 is accomplished through the aperture in liner 63 prior to sealing with cap 65. At a different location on container 11, a small opening 71 is provided through the wall of container 11. Opening 71 is kept sealed with, for example, an adhesive strip 73 until it is intended to withdraw beverage from the interior of liner 63 disposed within container 11. When adhesive strip 73 is removed, the space between liner 63 and container 11 is open to the atmosphere permitting beverage to be withdrawn through neck 23 without creation of vacuum which would interrupt withdrawal for as beverage is withdrawn, liner 63 simply collapses around the remaining beverage while maintaining the separation of the contained beverage from atmospheric oxygen or other contaminants.

Referring now to FIG. 5, there are shown, schematically, two separate beverage containers which may be of the removable type described above, according to this invention or may be of a more permanent type such as that described in my copending application Ser. No. 459,935 filed Jan. 21, 1983 and now abandoned. Beverage I from container 75 passes by gravity flow (or by pressure or pumping if desired) from container 75 through conduit 77 and through a cooling section 79 immersed in fluid cooling bath 81, which is maintained at constant temperature, and thence to dispensing valve 83 where Beverage I can be withdrawn on demand for serving. In like fashion Beverage II passes via conduit 85 from container 87 through a cooling section 89 immersed in cooling bath 81 and thence to dispensing valve 91 where Beverage II can be withdrawn as shown. Cooling bath 81 is preferably comprised of container containing cooling fluid 93 which is preferably non-toxic and which has a freezing point safely below the temperature which it is desired to maintain the cooling bath. Ethylene glycol and mixtures of ethylene glycol and water are preferred. The temperature of cooling fluid 93 is maintained at a desired level by an external refrigeration unit which supplies coolant fluid to the cooling bath via cooling coil 95. The temperature and flow of coolant fluid from and back to the refrigeration unit is regulated by thermostat 97 in a manner well known to those skilled in the art.

A particular advantage of the apparatus shown in FIG. 5 resides in the ability to dispense Beverages I and II at different temperatures despite the fact that the coolant fluid is maintained at a single constant temperature. This is accomplished by varying the length and diameter of the cooling section of conduit through which beverage passes, which is immersed in cooling bath 81 for each of the different beverages to be dispensed. It should be appreciated that while FIG. 5 illustrates apparatus for dispensing only two separate beverages, any number of beverages can be dispensed all at different temperatures by passage through a single cooling bath maintained at a single constant temperature. In addition to the conduit length and diameter passing through the cooling bath, it is also important to take into account the volume of beverage contained in the conduit after it passes outside of the cooling bath due to the effect of ambient temperature. It must also be noted that dilution of this volume is relatively large in relation to the volume of the container, for example a beverage glass into which beverage is to be dispensed. It is generally preferred therefore, to minimize the length and/or the diameter of beverage conduit between the point where it leaves the cooling bath and the dispensing valve. In FIG. 5 conduit cooling section 79 as shown, is larger in diameter and has a longer path through cooling bath 81 than does conduit cooling section 89, thus while both Beverage I and Beverage II will be cooled, Beverage I will be dispensed at a lower temperature than Beverage II. Those skilled in the art will understand that the following parameters can be taken into consideration in designing apparatus to achieve the desired degree of beverage cooling in accordance with this invention:

A. The length of conduit immersed in the cooling bath
B. The diameter of conduit immersed in the cooling bath
C. The volume of the container into which the beverage is to be dispensed
D. The length and diameter of conduit between the exit from the cooling bath and the dispensing valve
E. The temperature selected for the cooling bath
F. The heat exchange characteristics of the beverage conduit Those skilled in the art will have no difficulty in designing apparatus in accordance with this invention to cool and dispense beverage at a desired temperature. I have found for example that the parameters shown in Table I below will dispense beverage (wine) at the temperatures indicated.

TABLE I

| | Beverage A | Beverage B | Beverage C |
|---|---|---|---|
| Immersed (cold) length of conduit* | 264 in. | 156 in. | 40 in. |
| Immersed (cold) diameter of conduit | 0.5 in. | 0.5 in. | 5/16 in. |
| Immersed (cold) volume | 849 cc. | 502 cc. | 50 cc. |
| Non-immersed length of conduit (ambient) | 5 in. | 18 in. | 15 in. |
| Non-immersed diameter of conduit (ambient) | 0.5 in. | 0.5 in. | ½ in. |
| Non-immersed volume | 16 cc. | 58 cc. | 48 cc. |
| Cooling bath** temp. | 32° F. | 32° F. | 32° F. |
| Temp. 1st 100 cc withdrawn | ~40° F. | ~60° F. | ~56° F. |
| Temp. 2nd 100 cc withdrawn | ~32° F. | ~32° F. | ~56° F. |
| Temp. Normal Continuous Flow Rate | ~36.5° F. | ~50° F. | ~60° F. |

*Stainless Steel
**Ethylene glycol and water

Inspection of the data presented in Table I shows that the first 100 cc of Beverage A withdrawn will have a temperature of approximately 40° F., assuming an ambient temperature of 80° F. and disregarding as de minimus warming due to the heat of the beverage container and warming due to the temperature of the dispensing valve. A second 100 cc withdrawn immediately will have a temperature equivalent or somewhat above the cooling bath temperature which in this example is 32° F. On a continuous flow basis the beverage temperature will be approximately 36.5° F., all of which temperatures are quite acceptable for white wine for example.

With respect to Beverage B, beginning from a static temperature stabilized condition, the first 100 cc withdrawal will have a temperature of approximately 60° F. while the second 100 cc withdrawal will have a temperature somewhat above 32° F. (note that the volume of tubing exposed to ambient temperature is nearly four times greater than in the case of the Beverage A example). On a continuous delivery basis, Beverage B will be dispensed at a temperature of approximately 50° F.

In the case of Beverage C, the first 100 cc withdrawal will have a temperature of about 56° F. A second 100 cc immediately withdrawn will have a temperature of about 60° F. which, due to the short length of the immersed cold conduit, is essentially the same as the continuous flow rate. Thus, in the case of Beverage C the delivered temperature of beverage under all conditions will vary from about 56° F. to about 60° F. under all conditions, which are about ideal for red wine.

Those skilled in the art will have no difficulty in calculating immersed (cooled) and non-immersed (uncooled) tubing lengths, diameters and volumes needed to deliver beverages at desired different temperatures.

I claim:

1. A beverage dispensing device which comprises:

(A) A removable container for beverage which comprises:

(a) a container capable of storing beverage without exposure to atmospheric air;

(b) an expandable bag, disposed within said container, whose interior is capable of being opened through the wall of the said container to the atmosphere without exposing beverage contained in the interior of said container to atmospheric air;

(c) flow means located on said container for allowing beverage to flow from said container;

(d) vent means for opening a portion of the wall of said container to permit atmospheric air to enter the interior of said expandable bag to allow beverage to be withdrawn from said container by gravity without exposing beverage contained in the interior of said container to atmospheric air;

(B) closure means adapted to close said flow means to prevent leakage of beverage from said container during transport and storage;

(C) sealing means adapted to engage said flow means in sealing engagement, in relation to atmospheric air;

(D) puncture means associated with or included in said sealing means for opening said closure means;

(E) conduit means leading from said sealing means to a controllable valve for withdrawal of beverage from said container on demand; and (F) cooling means for cooling beverage withdrawn through said valve comprising:

(a) a cooling bath capable of being maintained at essentially a constant predetermined temperature;

(b) a first conduit means of predetermined length and diameter, a predetermined portion of which is immersed in said cooling bath such that the volume of beverage contained in the immersed and non-immersed portions of said conduit, the temperature of said cooling bath, the heat transfer characteristics of said conduit, and the rate of flow of beverage through said conduit will cool beverage delivered from said controllable valve relative to the ambient temperature over a predetermined temperature range; and (c) at least a second conduit means associated with a source of beverage and leading to a controllable valve for withdrawing beverage, wherein a portion of said conduit is immersed in said cooling bath and one or more of the heat transfer properties, diameter, length, ratio of immersed to non-immersed portions of conduit or rate of flow of beverage through said conduit upon withdrawal from said controllable valve are varied to cool beverage on delivery from said valve over a predetermined temperature range different from the temperature of beverage delivered through said first conduit.

2. A beverage dispensing device according to claim 1 wherein said valve means is positioned below said sealing means.

3. A beverage dispensing device according to claim 1 wherein said valve means is positioned at a distance sufficiently below the said sealing means such that upon first insertion of said removable container into said sealing means and opening of said valve means the flow of beverage through said conduit means and valve means creates a sufficient vacuum to cause said flow means to be drawn into said sealing means to a distance sufficient to cause said closure means to be punctured by said puncture means thereby permitting the flow of beverage from said container into said conduit by gravity.

4. A beverage dispensing device which comprises:

(A) A removable container for beverage which comprises:

(a) a container;

(b) a collapsible bag, disposed within said container, capable of storing beverage without exposure to atmospheric air;

(c) puncturable flow means associated with said bag and said container for allowing beverage to flow from said collapsible bag;

(d) vent means for opening a portion of the wall of said container to permit atmospheric air to enter the space between the walls of said container and the exterior of said collapsible bag to allow beverage to be withdrawn from said bag by gravity without exposing beverage contained in the interior of said bag to atmospheric air;

(B) closure means adapted to close said flow means to prevent leakage of beverage from said bag during transport and storage;

(C) seal means adapted to engage said flow means in sealing engagement, in relation to atmospheric air;

(D) puncture means associated with or included in said sealing means for opening said closure means;

(E) conduit means leading from said sealing means to a controllable valve for withdrawal of beverage from said bag on demand wherein said valve is positioned at a distance sufficiently below the said flow means such that upon insertion of said removable container into said sealing means and opening of said valve means, a flow of beverage, if present therein, through said conduit means and valve means is capable of creating a vacuum which together with the weight of said container is sufficient to cause said container to be drawn into said sealing means to a distance sufficient to cause said puncture closure means to be punctured by said puncture means thereby permitting the flow of beverage from said container into said conduit by gravity.

(F) a cooling bath capable of being maintained at essentially a constant predetermined temperature in which a predetermined portion of said conduit is immersed such that the volume of beverage contained in the immersed and non-immersed portions of said conduit, the temperature of said cooling bath, the heat transfer characteristics of said conduit, and the rate of flow of beverage through said conduit will cool beverage delivered from said controllable valve relative to the ambient temperature over a predetermined temperature range; and (G) at least a second conduit means associated with a source of beverage and leading to a controllable valve for withdrawing beverage, wherein a portion of said conduit is immersed in said cooling bath and one or more of the heat transfer properties, diameter, length, ratio of immersed to non-immersed portions of conduit or rate of flow of beverage through said conduit upon withdrawal from said controllable valve are varied to cool beverage on delivery from said valve over a predetermined temperature range different from the temperature of beverage delivered through the first mentioned conduit.

* * * * *